United States Patent [19]

Sweany

[11] 4,284,139

[45] Aug. 18, 1981

[54] PROCESS FOR STIMULATING AND UPGRADING THE OIL PRODUCTION FROM A HEAVY OIL RESERVOIR

[75] Inventor: Glenn A. Sweany, Stamford, Conn.

[73] Assignee: Conoco, Inc., Ponca City, Okla.

[21] Appl. No.: 125,594

[22] Filed: Feb. 28, 1980

[51] Int. Cl.[3] ..... C10G 13/00; E21B 43/24

[52] U.S. Cl. ..... 166/267; 166/303; 208/56

[58] Field of Search ..... 166/265, 266, 267, 272, 166/303; 208/56

[56] References Cited

U.S. PATENT DOCUMENTS

| | | | |
|---|---|---|---|
| 2,324,172 | 7/1943 | Parkhurst | 166/266 |
| 3,150,716 | 9/1964 | Strelzoff et al. | 166/272 |
| 3,228,467 | 1/1966 | Schlinger et al. | 166/266 |
| 3,273,640 | 9/1966 | Huntington | 166/266 |
| 3,344,856 | 10/1967 | Lange | 166/266 X |
| 3,780,805 | 12/1973 | Green | 166/266 |
| 3,946,810 | 3/1976 | Barry | 166/272 |
| 4,007,786 | 2/1977 | Schlinger | 166/266 |
| 4,050,515 | 9/1977 | Hamrick et al. | 166/303 |
| 4,115,246 | 9/1978 | Sweany | 208/56 |
| 4,119,149 | 10/1978 | Wu et al. | 166/266 |

*Primary Examiner*—Stephen J. Novosad

*Assistant Examiner*—George A. Suchfield

*Attorney, Agent, or Firm*—A. Joe Reinert

[57] ABSTRACT

A process for thermally stimulating and upgrading oil production from a heavy oil reservoir wherein the heavy oil produced from the reservoir is combined with a hydrogen donor diluent and the mixture is subjected to thermal cracking to upgrade the heavy oil into more valuable hydrocarbon products. The cracked products are fractionated into a light end vapor fraction, an intermediate liquid fraction, a gas oil fraction and a pitch fraction, and at least a portion of the gas oil fraction is hydrogenated by contacting it with a hydrogen-containing gas stream to produce the hydrogen donor diluent combined with the heavy oil. The pitch fraction is subjected to partial oxidation to produce the hydrogen-containing gas stream and a by-product gas stream containing steam which is combined with additional steam and injected into the heavy oil reservoir to enhance the mobility of heavy oil contained therein. The light end vapor fraction and unreacted hydrogen-containing gas produced by the process are utilized as fuel in the process. The intermediate liquid fraction produce and portion of the gas oil fraction not hydrogenated are readily transportable from the process.

8 Claims, 1 Drawing Figure

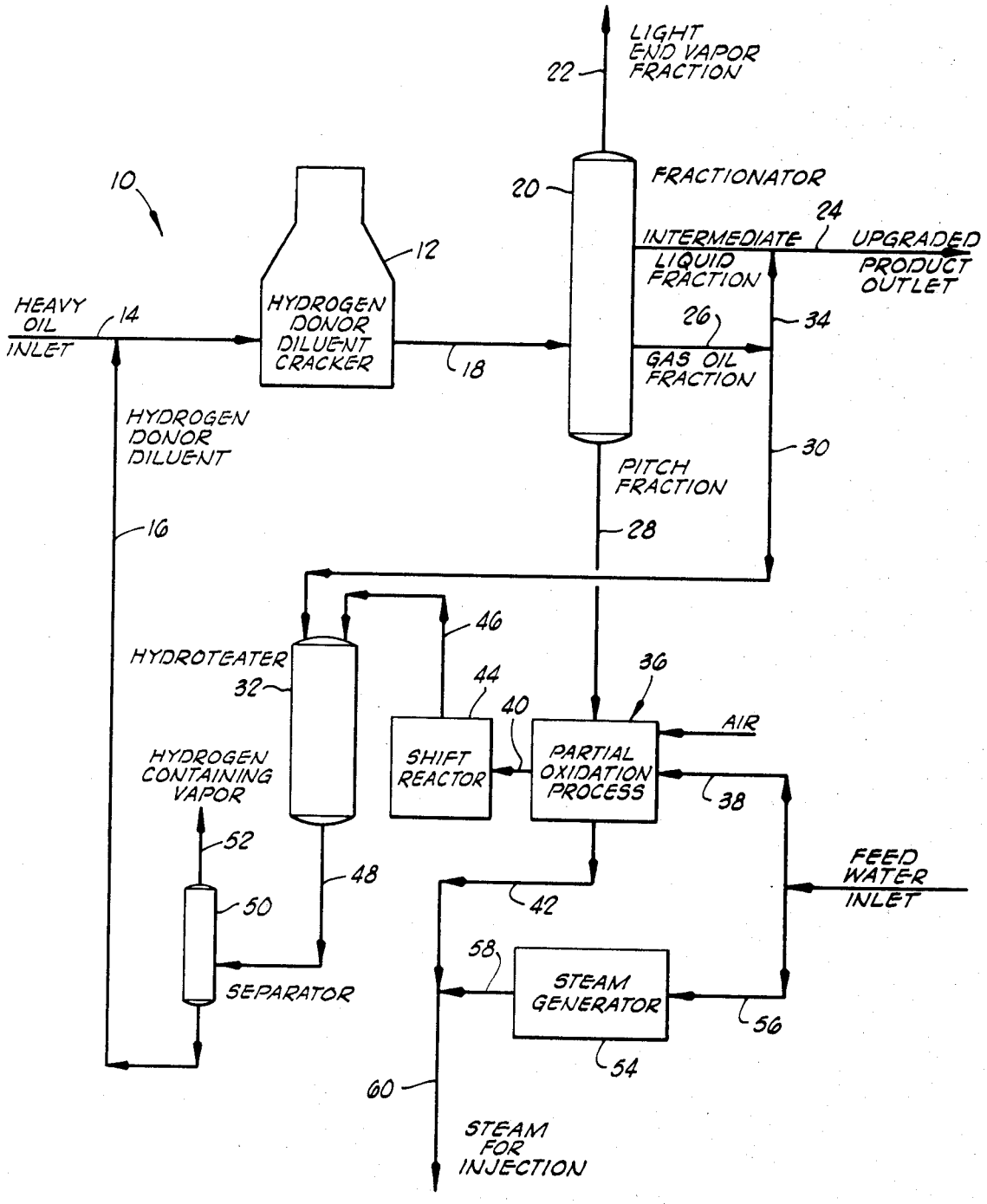
LIGHT END VAPOR FRACTION
22
10
20
FRACTIONATOR
24
INTERMEDIATE LIQUID FRACTION
UPGRADED PRODUCT OUTLET
12
HEAVY OIL INLET
14
HYDROGEN DONOR DILUENT CRACKER
26
34
18
GAS OIL FRACTION
HYDROGEN DONOR DILUENT
30
PITCH FRACTION
16
28
46
HYDROTEATER
32
44
36
40
AIR
SHIFT REACTOR
PARTIAL OXIDATION PROCESS
HYDROGEN CONTAINING VAPOR
38
52
48
FEED WATER INLET
50
42
58
STEAM GENERATOR
SEPARATOR
56
54
60
STEAM FOR INJECTION

PROCESS FOR STIMULATING AND UPGRADING THE OIL PRODUCTION FROM A HEAVY OIL RESERVOIR

BACKGROUND OF THE INVENTION

1. Field of the Invention

This invention relates to a process for stimulating and upgrading the oil production from a heavy oil reservoir, and more particularly, but not by way of limitation, to an on-site process for stimulating oil production from a heavy oil reservoir and upgrading the heavy oil produced to more valuable readily transportable products.

2. Description of the Prior Art

A prior art process known as the hydrogen donor diluent cracking process (HDDC) is described in detail in U.S. Pat. No. 2,953,513. In accordance with the process, low value hydrocarbon fractions are upgraded by thermal cracking in the presence of a hydrogen donor diluent. An improved hydrogen donor diluent cracking process is described in detail in U.S. Pat. No. 4,115,246. In accordance with such process, the pitch fraction resulting from fractionation of the products from the hydrogen donor diluent cracking step is subjected to partial oxidation, and the hydrogen-containing gas produced by the partial oxidation step is utilized to hydrogenate the recycled hydrogen donor diluent.

Throughout the world there are a number of heavy oil reservoirs, i.e., formations containing heavy oil which cannot be recovered by conventional means due to the extremely high viscosity of the oil. Examples of such reservoirs are the tar sands or bitumen sand deposits, the larger of which are found in Canada, Venezuela and the United States. These and other heavy oil reservoirs are being produced, at least to some extent, through the use of thermal recovery processes including processes which involve the injection of steam and hot water into the reservoir to enhance the mobility of the heavy oil contained therein. While the various thermal recovery processes which have been developed and used heretofore for stimulating oil production from heavy oil reservoirs have achieved varying degrees of success, a problem common to all such processes is that once the heavy oil is produced, it is difficult to handle and particularly difficult to transport from the production site due to its high viscosity and low pour point.

By the present invention an improved process for producing heavy oil reservoirs is provided wherein the heavy oil recovered is upgraded to more valuable readily transportable products at the production site and the effluent streams from the process are either injected into the reservoir or used as fuel thereby making the process largely self-sustaining.

SUMMARY OF THE INVENTION

A process for stimulating and upgrading the oil production from a heavy oil reservoir comprising the steps of combining the heavy oil produced from the reservoir with a hydrogen donor diluent and subjecting the mixture to thermal cracking. The thermally cracked products are fractionated to produce a light end vapor fraction, an intermediate liquid fraction, a gas oil fraction and a pitch fraction, and at least a portion of the gas oil fraction is hydrogenated by contacting said portion with a hydrogen-containing gas stream to produce the hydrogen donor diluent combined with the heavy oil. The pitch fraction is subjected to partial oxidation to produce the hydrogen-containing gas stream utilized to hydrogenate the recycled portion of the gas oil fraction. Steam is generated for injection into the heavy oil reservoir and by-products from the partial oxidation process are combined therewith prior to injection. The light end vapor fraction and unreacted hydrogen-containing gas produced by the process are utilized as fuel for the process.

Thus, it is a general object of the present invention to provide an improved process for stimulating and upgrading the oil production from a heavy oil reservoir.

A further object of the present invention is the provision of an on-site process for stimulating the production of heavy oil from a heavy oil reservoir wherein the heavy oil produced from the reservoir is upgraded to more valuable products which are more readily transported from the site to a point of use or further processing.

Yet a further object of the present invention is the provision of an on-site process for stimulating the oil production from a heavy oil reservoir and upgrading the heavy oil produced, which process is largely self-sustaining.

Other and further objects, features and advantages of the invention will be readily apparent to those skilled in the art upon a reading of the description of preferred embodiments which follows when taken in conjunction with the accompanying drawing.

BRIEF DESCRIPTION OF THE DRAWING

In the drawing forming a part of this disclosure, the process of the present invention is illustrated in schematic form.

DESCRIPTION OF PREFERRED EMBODIMENTS

Referring now to the drawing, the process of the present invention is illustrated and generally designated by the numeral 10. Heavy oil produced from a heavy oil reservoir and having free water separated therefrom is conducted to a hydrogen donor diluent cracking furnace 12 by a conduit 14. A conduit 16 for conducting a hydrogen-rich donor diluent is connected to the conduit 14 whereby the heavy oil flowing therethrough is mixed with the hydrogen donor diluent prior to entering the furnace 12. While within the furnace 12, the mixture of heavy oil and hydrogen donor diluent is subjected to thermal cracking whereby cracked products are produced which exit the furnace 12 by way of a conduit 18 connected thereto. The conduit 18 leads the cracked products to a conventional fractionator 20 wherein the cracked products are fractionated into a light end vapor fraction, an intermediate liquid fraction, a gas oil fraction and a pitch fraction which are removed from the fractionator 20 by conduits 22, 24, 26 and 28, respectively.

Depending on the operating conditions of the furnace 12, all or a portion of the gas oil fraction is conducted by a conduit 30 connected to the conduit 26 to a hydrotreater 32 wherein the gas oil is contacted with a hydrogen-containing gas stream to produce a hydrogen-rich donor diluent. The remaining portion of the gas oil, if any, is conducted by a conduit 34 connected to the conduit 26 to the conduit 24 where it combines with the intermediate liquid fraction withdrawn from the fractionator 20. The combined liquid product stream is conducted by the conduit 24 to a pipeline or other means for transporting the product to a point of use or further processing.

The pitch fraction withdrawn from the fractionator 20 by way of the conduit 28 is conducted to a partial oxidation process generally designated by the numeral 36. Within the process 36 the pitch is subjected to a non-catalytic controlled partial oxidation reaction such as that described in detail in *Chemical Engineering Progress,* Vol. 57, No. 7, pages 68–74. As described in that article, the oxidizing gas may be air and the products from the partial oxidation reaction consist of hydrogen and carbon monoxide. In accordance with the present invention, the partial oxidation reaction is moderated by steam produced from feed water conducted to the process 36 by a conduit 38 connected thereto. The hydrogen-containing product gas stream from the partial oxidation process 36 is withdrawn therefrom by way of a conduit 40 connected thereto, and a by-product stream largely comprised of steam is withdrawn from the process 36 by way of a conduit 42 connected thereto.

The hydrogen-containing product gases from the partial oxidation process 36 withdrawn therefrom by way of the conduit 40 can optionally be conducted to a conventional shift reactor for increasing the hydrogen concentration in the gas stream if required. From the shift reactor 44, if used, the hydrogen-containing gas stream is conducted to hydrotreater 32 where the hydrogen therein is used to hydrotreat the gas oil flowing through the hydrotreater 32 to produce a hydrogenated diluent. The resulting hydrogen donor diluent as well as excess hydrogen-containing gas and vaporized hydrocarbons are withdrawn from the hydrotreater 32 by way of a conduit 48 connected thereto and to a separator 50. While flowing through the separator 50 vapors are removed from the hydrogen donor diluent by way of a conduit 52 connected thereto and the remaining hydrogen donor diluent is withdrawn from the separator 50 by way of the conduit 16 connected thereto and to the heavy oil inlet conduit 14.

A conventional steam generator 54 is utilized in the process 10 to generate steam from feed water conducted thereto by a conduit 56. The steam generated by the steam generator 54 is withdrawn therefrom by way of a conduit 58 which is connected to the conduit 42. Thus, the by-product stream from the partial oxidation process 36 consisting primarily of steam and withdrawn therefrom by way of the conduit 42 is combined with the steam generated in the steam generator 54 withdrawn therefrom by way of the conduit 58 and is conducted by way of a conduit 60 to the point of injection of steam into the heavy oil reservoir being thermally stimulated and produced.

Thus, the process 10 is located at the site of one or more heavy oil reservoirs penetrated by one or more steam injection wells, and the steam generated by the process 10 is injected by way of the injection wells into the reservoirs to enhance the mobility of heavy oil contained therein whereby it can be produced through production wells to the surface. Once the heavy oil so produced reaches the surface, free water is separated therefrom and the heavy oil is conducted by way of the conduit 14 to the process 10 wherein it is upgraded into more valuable lighter products, namely, an intermediate liquid fraction and gas oil, which are readily and easily transported from the site by way of a pipeline or other means. The light end vapor fraction withdrawn from the fractionator 20 by way of the conduit 22 and the hydrogen and hydrocarbon-containing vapors withdrawn from the separator 50 by the conduit 52 are utilized as fuel gas in the process 10. Additional fuel requirements for the process 10 are supplied by diverting a portion of the heavy oil inlet to the process or by an alternate source of available fuel.

In order to facilitate a clear understanding of the improved process of the present invention, the following example is given.

EXAMPLE 555 pounds/unit time of produced heavy oil is conducted to the process 10 by way of the conduit 14. 215 pounds of the heavy oil is diverted as fuel for the process 10 leaving a remainder of 339 pounds which is combined with 320 pounds of hydrogen donor diluent by way of the conduit 16 connected to the conduit 14. A total combined stream of 559 pounds of heavy oil and donor diluent is conducted to the hydrogen donor diluent cracker 12 and the products therefrom are fractionated in the fractionator 20 producing 6.19 pounds of light end vapor fraction withdrawn from fractionator 20 by way of the conduit 22 and utilized as fuel in the process 10, a combined upgraded product stream of 259 pounds which is withdrawn from the process 10 by way of the conduit 24, and 72.9 pounds of pitch which are conducted to the partial oxidation process 36 by the conduit 28. 431.9 pounds of air are utilized in the process 36 to produce a 504.8 pound stream of hydrogen-containing gas which is conducted to the hydrotreater 32. 204 pounds of by-product stream consisting primarily of steam is withdrawn from the partial oxidation process 36 by way of the conduit 42 which is combined with 2,663 pounds of steam generated in the steam generator 54 to produce a total combined stream of 2,867 pounds of steam (1150 BTU/lb.) for injection into the heavy oil reservoir.

This compares with a conventional steam generator system (thermal efficiency of 80%) which in order to produce steam at a rate of 2,867 pounds/the same unit time as above (1150 BTU/lb.) requires 233 pounds of heavy oil for fuel and thereby produces 332 pounds net production of heavy oil.

While the heavy oil net production from a conventional steam generator system is greater than the net production produced by the process of the present invention, the production from the process of the present invention is in the form of more valuable readily transported products.

The embodiments of the invention in which an exclusive property of privilege is claimed are defined as follows:

1. A process for stimulating and upgrading the oil production from a heavy oil reservoir comprising the steps of:

(a) combining heavy oil produced from said reservoir with a hydrogen donor diluent;

(b) subjecting the mixture of heavy oil and hydrogen donor diluent to thermal cracking in a hydrogen donor diluent furnace;

(c) fractionating the cracked products from said hydrogen donor diluent furnace into a light end vapor fraction, an intermediate liquid fraction, a gas oil fraction and a pitch fraction;

(d) hydrogenating at least a portion of said gas oil fraction by contacting said portion with a hydrogen-containing gas stream in a hydrotreater to produce the hydrogen donor diluent combined with said heavy oil in accordance with step (a) and an unreacted hydrogen-containing gas stream effluent;

(e) subjecting said pitch fraction to partial oxidation to produce the hydrogen-containing gas stream utilized in step (d) and a by-product gas stream;

(f) generating steam in a steam generator;

(g) combining said steam generated in step (f) with the by-product gas stream from step (e);

(h) injecting said combined steam-by-product gas stream into said heavy oil reservoir to thereby stimulate the production of heavy oil therefrom; and (i) utilizing said light end vapor fraction from step (c) and said unreacted hydrogen-containing gas stream effluent from step (d) as fuel for said process.

2. The process of claim 1 wherein said partial oxidation process is carried out utilizing air as the oxidizing gas.

3. The process of claim 2 wherein said intermediate liquid fraction and the portion of said gas oil fraction from step (c) not hydrogenated in accordance with step (d) are transported from said process by pipeline.

4. The process of claim 1 wherein said hydrogen-containing gas stream utilized in step (d) is first subjected to a shift reaction whereby the hydrogen content of said gas stream is increased.

5. In a process for stimulating oil production from a heavy oil reservoir wherein steam is injected into the reservoir to enhance the mobility of the heavy oil therein, the improvement comprising:

(a) combining heavy oil produced from said reservoir with a hydrogen donor diluent;

(b) subjecting the mixture of heavy oil and hydrogen donor diluent to thermal cracking;

(c) fractionating the cracked products from step (b) into a light end vapor fraction, an intermediate liquid fraction, a gas oil fraction and a pitch fraction;

(d) hydrogenating at least a portion of said gas oil fraction by contacting said portion with a hydrogen-containing gas stream to produce the hydrogen donor diluent combined with said heavy oil in accordance with step (a) and an unreacted hydrogen-containing gas stream effluent;

(e) subjecting said pitch fraction to partial oxidation to produce the hydrogen-containing gas stream utilized in accordance with step (d) and a by-product gas stream;

(f) combining the by-product gas stream from step (e) with said steam prior to injecting said steam into said reservoir; and (g) utilizing said light end vapor fraction from step (c) and said unreacted hydrogen-containing gas stream effluent from step (d) as fuel for said process.

6. The process of claim 5 wherein said partial oxidation process is carried out utilizing air as the oxidizing gas.

7. The process of claim 6 wherein said intermediate liquid fraction and the portion of said gas oil fraction from step (c) not hydrogenated in accordance with step (d) are transported from said process to a point of use or further processing by pipeline.

8. The process of claim 5 wherein said hydrogen-containing gas stream used in step (d) is first subjected to a shift reaction whereby the hydrogen content thereof is increased.

* * * * *